US005570794A

United States Patent [19]

Drower

[11] Patent Number: 5,570,794

[45] Date of Patent: Nov. 5, 1996

[54] STORAGE RACK FOR SMALL ARTICLES

[75] Inventor: Herbert M. Drower, Wilmette, Ill.

[73] Assignee: Transilwrap Company, Inc., Chicago, Ill.

[21] Appl. No.: 509,927

[22] Filed: Aug. 1, 1995

[51] Int. Cl.[6] ..... A47F 5/00

[52] U.S. Cl. ..... 211/89; 211/60.1; 211/69.8; 211/120

[58] Field of Search ..... 211/60.1, 69.8, 211/89, 70.6, 120, 94

[56] References Cited

U.S. PATENT DOCUMENTS

| | | | |
|---|---|---|---|
| D. 175,455 | 8/1955 | Bartleman . | |
| 231,969 | 9/1880 | Perkins . | |
| 586,238 | 7/1897 | King . | |
| 1,026,241 | 5/1912 | Buckingham | 211/120 |
| 1,214,606 | 2/1917 | Steig | 211/120 |
| 1,388,154 | 8/1921 | Coutts | 211/120 X |
| 1,429,846 | 9/1922 | Coutts | 211/120 |
| 1,508,680 | 9/1924 | Daniels | 211/120 |
| 1,822,734 | 9/1931 | Harrington | 211/120 |
| 2,430,624 | 1/1946 | Vollmer . | |
| 2,591,805 | 6/1950 | Gossett . | |
| 2,615,577 | 11/1950 | Bartleman . | |
| 3,305,100 | 1/1965 | Barbee . | |
| 3,405,809 | 9/1966 | Schatz . | |
| 3,812,976 | 5/1975 | Rempel . | |
| 4,176,752 | 12/1979 | Taber . | |
| 4,936,469 | 6/1990 | Drower . | |
| 5,419,443 | 5/1995 | Niederberger et al. | 211/89 X |

*Primary Examiner*—Robert W. Gibson, Jr.
*Attorney, Agent, or Firm*—Dorn, McEachran, Jambor & Keating

[57] ABSTRACT

A storage rack for small articles having an elongated support bar in which are formed a multiplicity of transverse slots along the length thereof. Each slot extends from the front to the back of the support bar and each slot is open at its top but closed at its bottom. A bottom ledge extends outwardly of the slots at the front and rear edges of the support bar. A tenon on the support bar extends upwardly into the slots. Undercuts are formed in the support bar creating overhangs on opposite sides of each slot above the tenon. A multiplicity of retainer loops formed of a strip of a tough, resilient, abrasive-resistant resin are provided. Each retainer loop has a bite portion positioned outwardly of the front edge of the support bar and two legs positioned in one of the slots with each leg engaging an overhang on an opposite side of its slot and the bottom ledge. A downwardly opening notch is formed in each leg with the notch fitted over and receiving the tenon to preclude withdrawal of the loops forwardly through the slots.

8 Claims, 3 Drawing Sheets

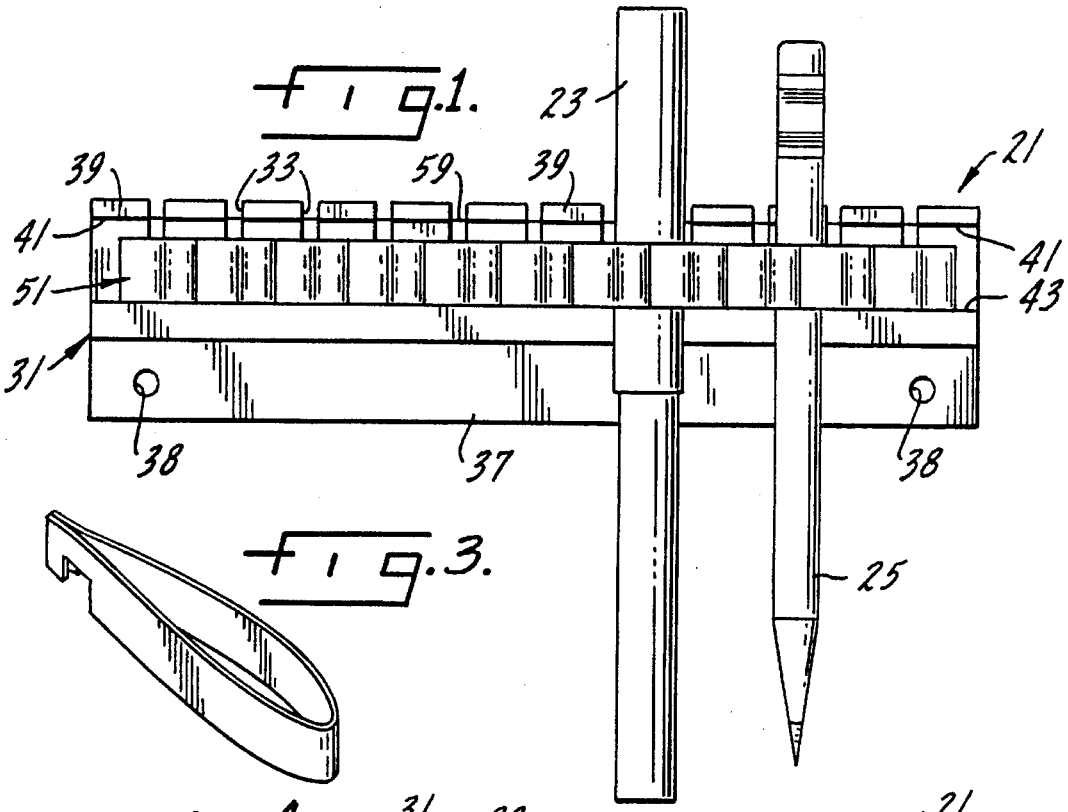
Fig. 1.
Fig. 3.
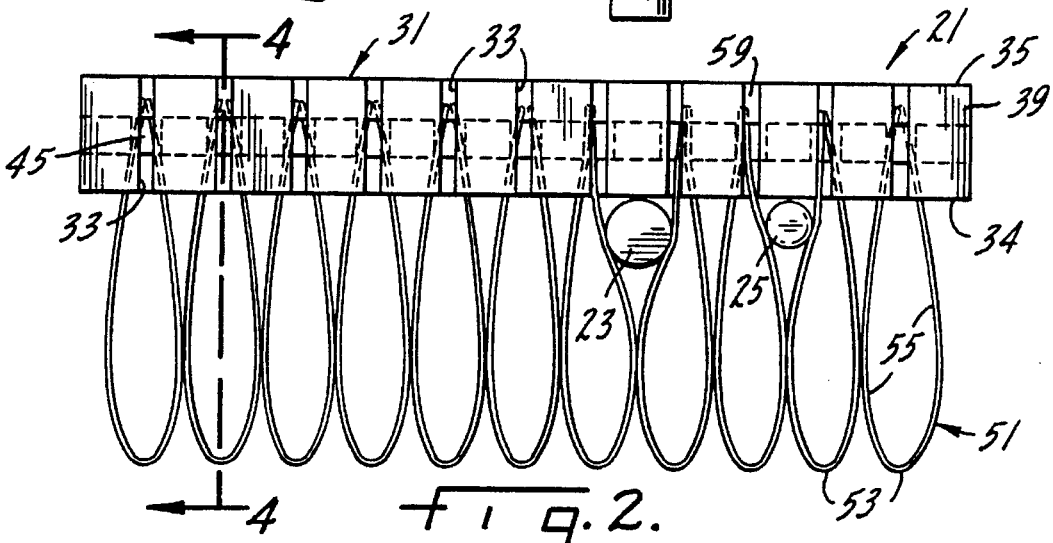
Fig. 2.
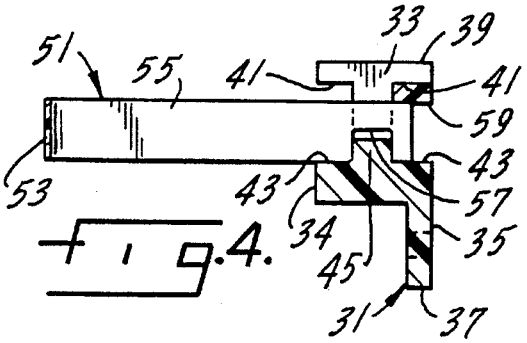
Fig. 4.
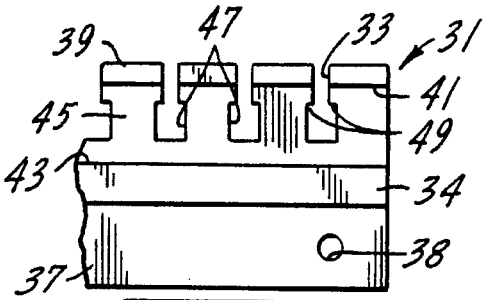
Fig. 5.

Fig. 6.
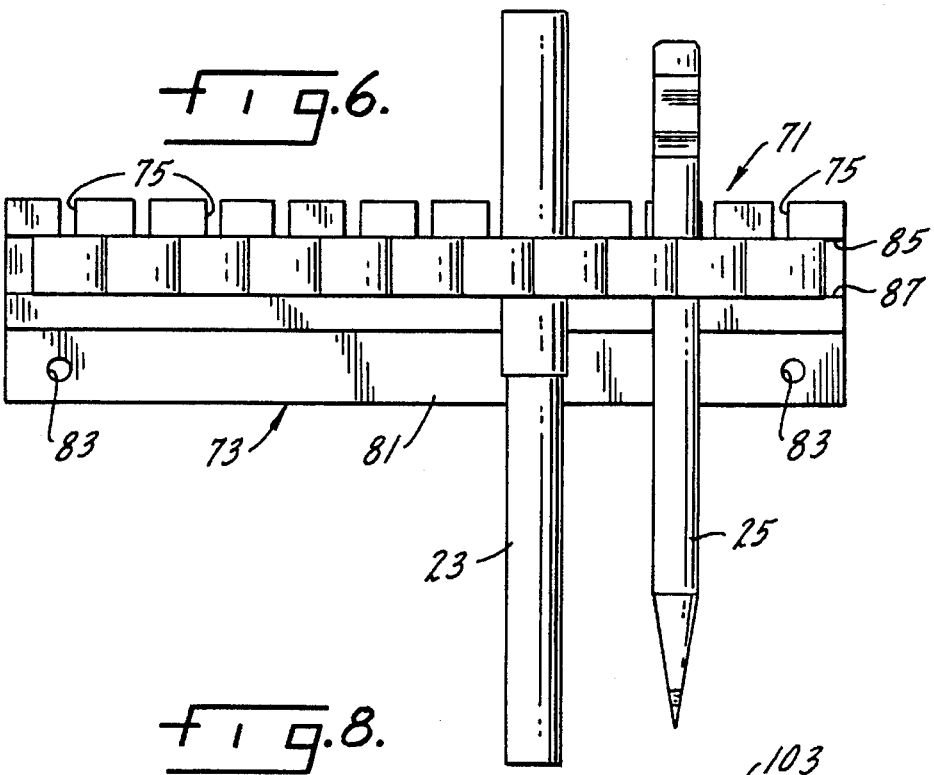
Fig. 8.
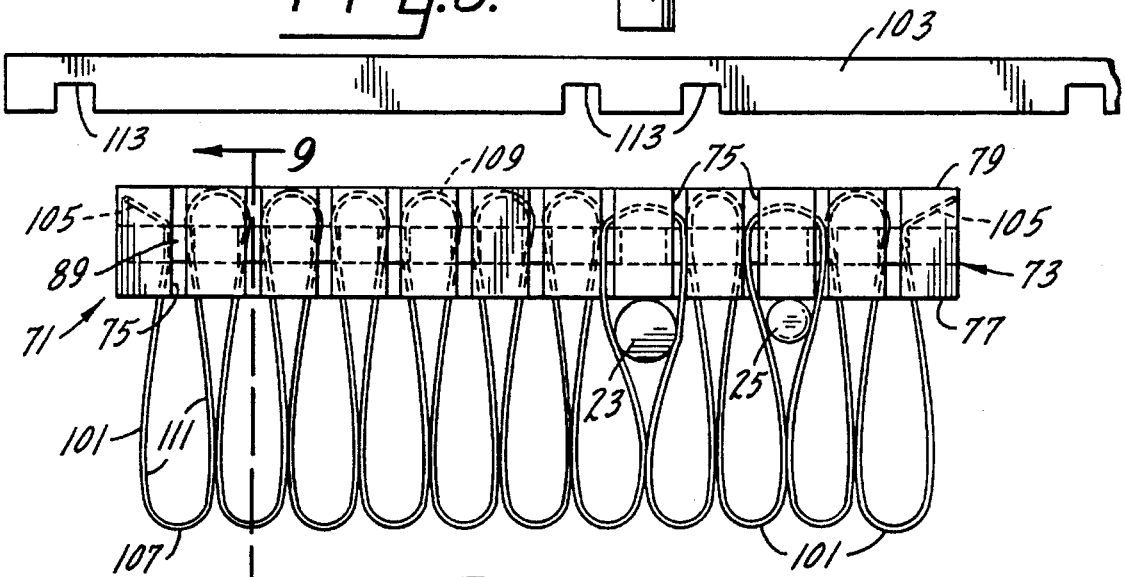
Fig. 7.
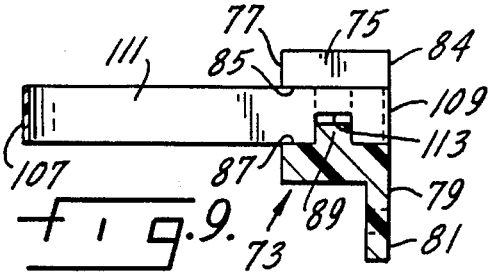
Fig. 9.
Fig. 10.
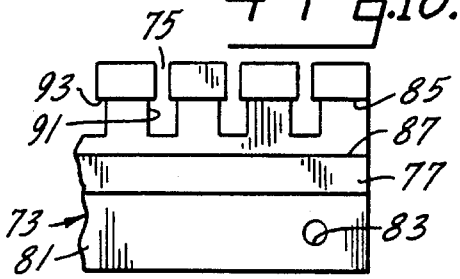

Fig.11.
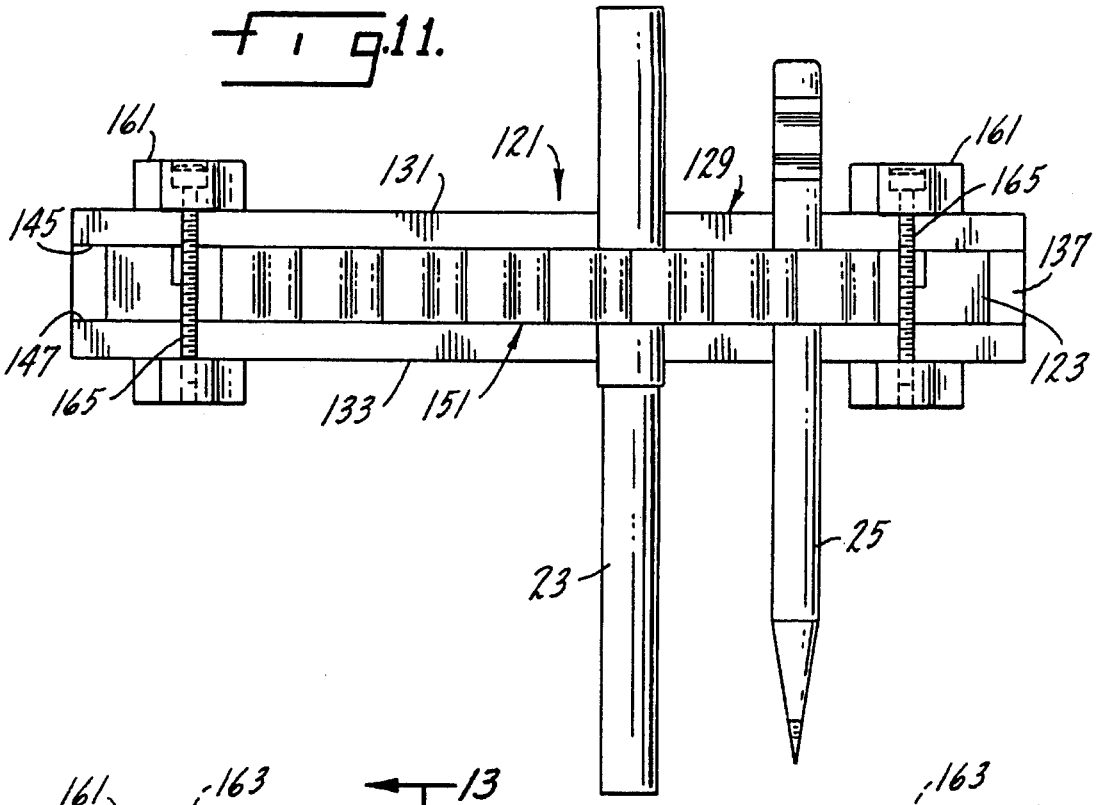
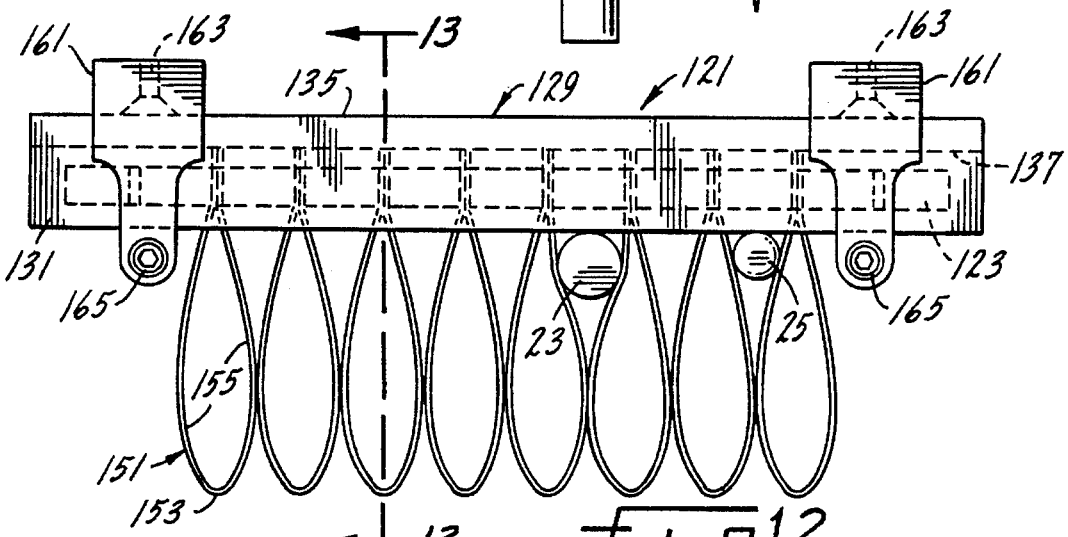
Fig.12.
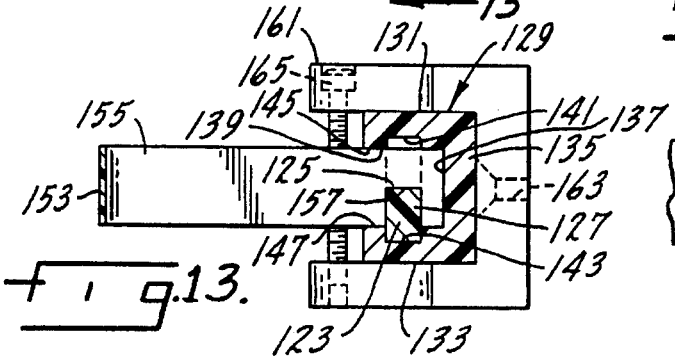
Fig.13.
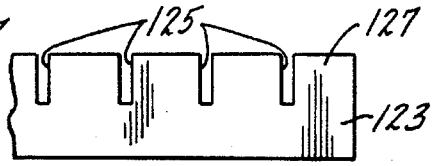
Fig.14.

STORAGE RACK FOR SMALL ARTICLES

BACKGROUND OF THE INVENTION

Storage racks for small articles, ranging from pencils and pens to other items such as paint brushes, cassettes and small containers are available in many sizes, styles, constructions and configurations. In the storage rack shown and described in my U.S. Pat. No. 4,936,469, issued Jun. 26, 1990, I provided a storage rack that is capable of storing thick, thin, long and short articles of virtually any shape or configuration with a minimum original set up time as well as a minimum revision time when it is necessary to change the storage rack to accommodate different types or shapes of articles. The construction of my prior storage rack required that the end portions of the legs of each retainer loop be bent at right angles to the adjacent portions of the legs and that they be positioned behind the slot into which the loop legs are inserted and also required a back member to engage the bent end portions of the legs to preclude withdrawal of the loops forwardly through the slots.

SUMMARY OF THE INVENTION

It is a principal object of the present invention, therefore, to provide a new and improved storage rack for small articles having an increased ability to hold objects of different sizes and shapes as well as being easier to manufacture and assemble than prior storage racks.

Another object of the invention is a new and improved storage rack for small articles that does not require bending of the ends of the retainer loops to preclude withdrawal of the retainer loops forwardly through the slots in which they are inserted.

An additional object of the invention is a storage rack that utilizes a single continuous strip of a resilient resin to form the retainer loops.

Yet another object of the invention is to mount the legs of the retainer loops in their slots to permit lateral movement of the ends of the legs to accommodate larger objects without reducing the holding power of the retainer loops.

Accordingly, the invention relates to a storage rack for small articles comprising an elongated support bar having a multiplicity of transverse slots spaced along its length, each slot extending from the front to the rear of the support bar and each slot being open at its top but closed at its bottom. A bottom ledge extends outwardly of the slots at the front and rear edges of the support bar. A tenon on the support bar extends upwardly into the slots. Undercuts are formed in the support bar to create overhangs on opposite sides of each slot above the tenon. The storage rack further comprises a multiplicity of retainer loops formed of a strip of a tough, resilient, abrasive-resistant resin; each retainer loop being formed with a bight portion positioned outwardly of the bottom ledge of the elongated support bar and two legs positioned in each slot with each leg engaging an overhang on an opposite side of its slot as well as engaging the bottom ledge. A downwardly opening notch is formed in each leg of each retainer loop with the notches fitting over and receiving the tenon to preclude withdrawal of the loops forwardly through the slots.

BRIEF DESCRIPTION OF THE DRAWINGS

The invention is illustrated more or less diagrammatically in the following drawings wherein:

FIG. 1 is a front elevational view of a storage rack for small articles constructed in accordance with one embodiment of the present invention;

FIG. 2 is a top plan view of the storage rack of FIG. 1;

FIG. 3 is a perspective view of one of the retainer loops of the storage rack of FIG. 1;

FIG. 4 is a cross sectional view taken along line 4—4 of FIG. 2;

FIG. 5 is a partial front elevational view of the elongated support bar of the storage rack of FIG. 1;

FIG. 6 is a front elevation view of a storage rack for small articles constructed in accordance with a second embodiment of the present invention;

FIG. 7 is a top plan view of the storage rack of FIG. 6;

FIG. 8 is a section of the strip material forming the retainer loops for the storage rack of FIG. 6;

FIG. 9 is a side elevational view taken along line 9—9 of FIG. 7;

FIG. 10 is a partial enlarged front elevational view of the support bar of the storage rack of FIG. 6;

FIG. 11 is a front elevational view of a storage rack for small articles constructed in accordance with a third embodiment of the present invention;

FIG. 12 is a top plan view of the storage rack of FIG. 11;

FIG. 13 is a cross sectional view taken along line 13—13 of FIG. 12; and FIG. 14 is a partial front elevational view of the support bar of the storage rack of FIG. 11.

DESCRIPTION OF THE PREFERRED EMBODIMENTS

FIGS. 1–5 of the drawings illustrate a storage rack 21 for storing small articles, constructed in accordance with one embodiment of the present invention. As shown in FIGS. 1 and 2, rack 21 is used for the storage of a variety of small articles of varying sizes, shapes and descriptions. Specifically for purposes of illustration and not by way of limitation, a pen 23 and a pencil 25 are shown stored in the rack. It should be understood and appreciated that other articles such as measuring tapes, chalk, putty knives, erasers, paint brushes, cassettes, etc., may also be stored in such a rack.

The storage rack 21, shown in FIGS. 1–5 of the drawings, is formed of an elongated support bar 31 having a multiplicity of transverse slots 33 formed at regularly spaced intervals along its length. The support bar may be formed of any suitable material such as wood or plastic, although plastic is preferred because of its light weight, low cost and ease of forming. In a typical storage rack of this embodiment of the invention, the center to center spacing between slots 33 may be on the order of ⅜ inch or less, but this spacing is not critical. The more slots 33 there are in the main support bar 31, the more versatile is the rack; however, when the spacing between the slots 33 is reduced to less than ¼ inch, there is little gain with respect to most of the types of small articles for which the rack 21 may be used to support. As will be apparent from FIGS. 2 and 4, each slot 33 is open at its top but closed at its bottom. Each slot 33 extends the full distance from a front surface 34 of support bar 31 to a rear surface 35 thereof. The designations front and rear are used for clarity of illustration and not by way of limitation although the rear surface 35 of the support bar will usually be in contact with or adjacent a supporting surface.

As can be best seen in FIG. 4, the elongated support bar 31 is of somewhat I-shaped transverse cross section having a downwardly extending flange 37 located at the rear surface 35 thereof. Circular passages 38 may be formed in this flange and used to receive screws or nails to fasten the support bar 31 to a supporting surface which is not shown herein.

The support bar 31 includes a cap-like portion 39 at the top having soffit-like surfaces 41 located at the front and rear surfaces of the bar. A ledge 43 is formed at the bottom of each transverse slot and extends between the front and rear surfaces of the bar with a tenon 45 extending upwardly into the slots 33 from this ledge. Undercuts 47 are formed in the bar on opposite longitudinal sides of each slot 33 to form longitudinally extending overhangs 49 as are most clearly shown in FIG. 5.

The storage rack 21 further includes a multiplicity of retainer loops 51. The retainer loops are each formed of a strip of tough, resilient, abrasive-resistant resin, preferably a polyester resin or laminate. The preferred resin for the retainer loops is two layers of oriented polyethylene terephthalate laminated with a central layer of polyethylene, the same basic construction as used in commercial identification cards and similar articles.

Each retainer loop 51 has a bight portion 53 joining a pair of legs 55. A notch 57 is formed in each leg near the distal end thereof. Each retainer loop 51 is mounted on the storage rack 21 by being inserted in a transverse slot 33 of the support bar 31 with the bight portion 53 of the loop extending forward of front surface 34 of the support bar 31. When so inserted, the notches 57 in the legs 55 fit over and receive the tenon 45 to preclude withdrawal of the retainer loops forwardly through the slots 33. The lower edges of legs 55 rest on the ledge 43 of the support bar 31. The top edges of the legs 55 engage the overhangs 49 formed in the undercuts 47 of the slots 33 to prevent withdrawal of the retainer loops 51 upwardly from the slots 33.

In some installations, but not all, it may desirable to install an elongated rectangular bar 59 between the upper edge of the legs 55 of the loops and the soffit-like surfaces 41 of the cap. In FIG. 4 of the drawings, this bar 59 is shown installed at the rear of the support bar but it may also be installed instead at the front of the support bar in contact with the tops of the retainer loop legs 55 and the soffit-like surface 41 at the front surface 34 of the support bar.

When the legs 55 of a retainer loop 51 are installed in a slot 33 of the support bar 31 with the notches 57 of the legs fitting over the tenon 45 of the support bar 31, the legs will be spaced from each other with only the distal ends of the legs in contact with each other, as shown most clearly on the left hand side of FIG. 2 of the drawings, and the lower edges of the legs will be supported on the ledge 43 at the front 34 surface of the support bar. The upper edges of the legs 55 will be in contact with the overhangs 49 on opposite sides of the undercuts 47 of the slots. When an article such as the pen 23 is inserted between a pair of adjacent retainer loops 51 next to the front surface 34 of the support bar 31, the legs of adjacent loops which engage the pen will be forced to opposite sides of their slots to positions adjacent the other legs of each loop and under the overhangs 49 on the opposite sides of their slots. This mounting of the retainer loops permits the accommodation of articles with larger diameters while still maintaining an adequate supporting pressure against the article.

FIGS. 6–10 of the drawings illustrate a storage rack 71 constructed in accordance with another embodiment of the invention. As with previously described storage rack 21, the storage rack 71 is used for the storage of a variety of small articles of varying sizes, shapes and descriptions. Specifically for purposes of illustration and not by way of limitation, a pen 23 and a pencil 25 are shown stored in the rack.

The storage rack 71 is formed of an elongated support bar 73 having a multiplicity of transverse slots 75 formed at regularly spaced intervals along its length. The support bar 73 may be formed of any suitable material such as wood or plastic, although plastic is preferred because of its light weight, low cost and ease of forming. In a typical storage rack of this embodiment of the invention, the center to center spacing between slots 75 may be on the order of ⅜ inch or less, but this spacing is not critical. The more slots 75 there are in the main support bar 73, the more versatile is the rack; however, when the spacing between the slots 75 is reduced to less than ¼ inch, there is little gain with respect to most types of small articles for which the rack 71 may be used. As will be apparent from FIGS. 7 and 9, each slot 75 extends the full distance from the front surface 77 of the support bar 73 to the rear surface 79 thereof. The designations front and rear are used for clarity of illustration and not be way of limitation although the rear surface 79 of the support bar will usually be in contact with or adjacent a supporting surface.

As can be best seen in FIG. 9, the elongated support bar 73 is of somewhat I-shaped transverse cross section having a downwardly extending flange 81 located at the rear surface 79 thereof. Circular passages 83 may be formed in this flange to be used to receive screws or nails to fasten the support bar 73 to a supporting surface which is not shown herein.

The support bar 73 includes a cap-like portion 84 at the top having soffit-like surfaces 85 located at the front and rear surfaces of the bar. A ledge 87 is formed at the bottom of each slot 75 extending between the front and rear surfaces of the bar with a tenon 89 extending upwardly into the slots 75 from this ledge. Undercuts 91 are formed in the bar on opposite longitudinal sides of each slot 75 to form longitudinally extending overhangs 93.

In contrast to the retaining loops 51 of the first embodiment of the invention, the retaining loops 101 of this embodiment formed of a single continuous strip 103 of a tough, resilient, abrasive-resistant resin, preferably a polyester resin or laminate. The preferred resin for the continuous strip which forms the retainer loops is two layers of oriented polyethylene terephthalate laminated with a central layer of polyethylene, the same basic construction as used in commercial identification cards and similar items. The strip 103 is serpentined through the slots 75 formed in the elongated support bar 73 of the storage rack 71 in the manner most clearly shown in FIGS. 7 and 9 of the drawings. The strip is bent at each of its ends 105, the portion of the strip between the ends formed into the retainer loops 101. Each retainer loop has a bight portion 107 which extends outwardly of the front surface 77 of the support bar 73 and a bight portion 109 extends to but not beyond the rear surface 79 of the support bar 73. Legs 111 are formed between the bights 107 and 109 with notches 113 formed in the legs adjacent the bight portions 109. The notches 113, as can be best seen in FIG. 9 of the drawings, fit over the tenon 89 to preclude withdrawal of the loops 101 forwardly through the slots 75. The lower edges of the legs 111 rest on the ledge 87 of the support bar 73. The top edges of the legs 111 engage the overhangs 93 formed in the undercuts 91 of the slots 75 to prevent withdrawal of the retainer loops 101 upwardly from the slots 75.

When an article, such as the pen 23, is inserted between a pair of adjacent retainer loops 101 at a location near the front surface 77 of the support bar 73, the legs 111 of adjacent loops which engage the pen will be forced to opposite sides of their slots to positions adjacent the other legs of each loop and under the overhangs 93 on the opposite sides of their slots. This mounting of the retainer loops permits the accommodation of articles with larger diameters while still maintaining an adequate supporting pressure against the article between the loops.

FIGS. 11–14 of the drawings illustrate a storage rack 121 constructed in accordance with yet another embodiment of the invention. As in the case of the previously described storage racks 21 and 71, it may be used for the storage of a variety of small articles of varying sizes, shapes and descriptions. Specifically for purposes of illustration and not by way of limitation, a pen 23 and a pencil 25 are shown supported in the storage rack in FIGS. 11 and 12 of the drawings.

The storage rack 121 is formed of an elongated support bar 73 of rectangular, transverse cross section having a multiplicity of transverse slots 125 formed at regularly spaced intervals along its length. As with the support bars previously described, the bar 123 may be formed of any suitable material such as wood or plastic. Also the center to center spacings between the transverse slots 125 may be the same as the spacings between the slots 33 and 75 previously described. Each slot 125 extends the full distance through the elongated support bar 123.

As can be best viewed in FIG. 13 of the drawings, the elongated support bar 123 is mounted in a channel-shaped support bar holder 129 which has a top wall 131, a bottom wall 133 and a rear wall 135 defining an elongated chamber 137 in the channel which is accessible through a front passage 139. The elongated support bar 123 is positioned in the elongated chamber 137 of the support bar holder 129 and is seated in a groove 141 formed in the top wall 131 and in an aligned groove 143 formed in the bottom wall 133. A soffit-like surface 145 is formed on the underside of the top wall 131 and a ledge 147 is formed on the upper part of the bottom wall 133 of the support bar holder 129.

The retaining loops 151 of this embodiment of the invention are similar in construction to the retaining loops 51 of the first described embodiment of this invention. Each retainer loop is formed of a strip of a tough, resilient, abrasive-resistant resin, preferably a polyester resin or laminate. The preferred resin for the retainer loops is two layers of oriented polyethylene terephthalate laminated with a central layer of polyethylene, the same basic construction is used in commercial identification cards and similar articles.

Each retainer loop 151 has a bite portion 153 joining a pair of legs 155. A notch 157 is formed in each leg near the distal end thereof. Each retainer loop 151 is mounted on the elongated support bar 123 by being inserted in a transverse slot 125 of the support bar 123 with the bite portion 153 of the loop extending through the front passage 139 of the support bar holder 129 so as to locate the bite portion 153 of each leg in front of the storage rack 121. When so inserted, the notches 157 in the legs 155 fit over and receive the tenon 127 of the elongated support bar to preclude withdrawal of the retainer loops forwardly through the transverse slots 125. The lower edges of the legs 155 rest on the ledge 147 of the support bar holder 129. The top edges of the legs 155 engage the soffit-like surfaces 145 of the top wall 133 of the support bar holder to prevent withdrawal of the retainer loops upwardly from the slots.

The support bar holder 129 is supported at its opposite ends in C-shaped support brackets 161 which may be attached to a supporting surface by fasteners, which are not shown, and which may be installed in holes or passages 163 formed in the support bracket. A threaded fastener 165 extends through the open end of the support bracket to retain the support bar holder in position.

I claim:

1. A storage rack for small articles, including:

an elongated support bar having a multiplicity of transverse slots spaced along its length, each slot extending from the front to the back of the support bar with each slot being open at the top but closed at the bottom of the slot, a bottom ledge extending outwardly of the slots at the front and rear edges of the support bar, a tenon on said support bar extending upwardly into said slots, undercuts formed in said support bar creating overhangs on opposite sides of each slot above said tenon, a multiplicity of retainer loops formed of a strip of a tough, resilient, abrasive-resistant resin, each retainer loop having a bight portion positioned outwardly of said bottom ledge and two legs positioned in one of said slots with each leg engaging an overhang on an opposite side of its slot and said bottom ledge, and a downwardly opening notch formed in each leg with said notch fitting over and receiving said tenon to preclude withdrawal of the loops forwardly through said slots.

2. The storage rack of claim 1 in which said multiplicity of retainer loops are formed as part of a single integral strip.

3. The storage rack of claim 2 in which each of said multiplicity of retainer loops, except those retainer loops at opposite ends of the elongated support bar, is connected to its adjacent retainer loops by a second bight portion joined to its legs.

4. The storage rack of claim 1 in which said legs of each retainer loop approach each other at the rear edge of said slot.

5. A storage rack for small articles, including:

a frame, an elongated support bar mounted on and supported by said frame, said support bar having a multiplicity of transverse slots spaced along its length, each slot extending from the front to the back of said support bar with each slot being open at the top but at least partially closed at the bottom of the slot by a tenon, a multiplicity of retainer loops formed of a strip of a tough, resilient, abrasive-resistant resin, each retainer loop having a bight portion positioned outwardly of said elongated support bar and having two legs positioned in one of said slots, a downwardly opening notch formed in each leg with said notch fitting over and receiving said tenon to preclude withdrawal of the loops forwardly through the slots, and a top member extending over the slots to preclude withdrawal of said loops upwardly through said slots.

6. The storage rack of claim 5 in which said multiplicity of retainer loops are formed as part of a single integral strip.

7. The storage rack of claim 6 in which each of said multiplicity of retainer loops, except those retainer loops at opposite ends of said elongated support bar, is connected to its adjacent retainer loops by a second bite portion joined to its legs.

8. The storage rack of claim 5 in which said legs of each retainer loop approach each other at the back edge of said slot.

* * * * *